United States Patent [19]

Neuser

[11] 4,386,253

[45] May 31, 1983

[54] SWITCH

[75] Inventor: Johannes Neuser, Netphen, Fed. Rep. of Germany

[73] Assignee: Hundt & Weber Schaltgeräte GmbH, Freudenberg-Wilhelmshöhe, Fed. Rep. of Germany

[21] Appl. No.: 206,918

[22] Filed: Nov. 14, 1980

[30] Foreign Application Priority Data

Nov. 15, 1979 [DE] Fed. Rep. of Germany ..... 2946124
May 28, 1980 [DE] Fed. Rep. of Germany ..... 3020208

[51] Int. Cl.[3] ..... H01H 35/32
[52] U.S. Cl. ..... 200/302; 200/144 B
[58] Field of Search ..... 200/302, 293, 159 B, 200/153 C, 153 CB, 144 B

[56] References Cited

U.S. PATENT DOCUMENTS 3,862,389 1/1975 Lowe ..... 200/302
3,950,628 4/1976 Hruda ..... 200/302
4,216,359 8/1980 Hruda ..... 200/144 B

*Primary Examiner*—Willis Little
*Attorney, Agent, or Firm*—M. J. Moran

[57] ABSTRACT

There is described a low voltage switch for currents up to several 1000 amps, as may occur in galvanic plants. The switch comprises contact elements being carried opposite to each other by supporting plates which are actuatable by axially effective forces, a casing hermetically enclosing the contact elements (the casing being formed by the supporting plates and an annular membrane), the membrane being hermetically connected to the two supporting plates. Such membrane has been made of sheet metal until now. To make production more economical and, furthermore, to reduce current leaks across contact material sprayed onto insulating members between the contact elements the annular membrane is formed by bellows of flexible, electrically insulating, plastic material, the rims of the bellows being connected by means of clamping devices to annular connection surfaces of the supporting plate surrounding the contact element.

26 Claims, 11 Drawing Figures

SWITCH

DESCRIPTION

Figure 1:
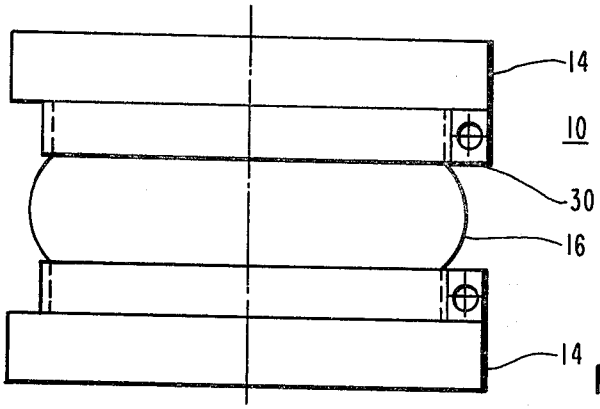

The invention deals with a switch having contact elements being opposite to each other which contact elements are carried by supporting plates being actuatable by forces being axially effective, and with a casing enclosing the contact elements hermetically being formed by the supporting plates and an annular membrane connected hermetically to the two supporting plates.

Such a switch being used as a low voltage switch is already known from the German Offenlegungsschrift No. 27 02 103 the casing of this known switch being evacuated so that the known switch is a low voltage vacuum switch. In such a vacuum switch the air pressure provides the supporting plates with a pressure force which has to be considered for the actuating device for the switch. This is a disadvantage since the switch is no longer universally usable. A further disadvantage is the necessity to evacuate the switch casing which makes producing of the switch much more complicated since the final assembly of the known switch including complicated soldering and plating procedures have to be effected under vacuum conditions.

A further disadvantage is the fact that the annular membrane member closing off the vacuum space between the contact elements comprises three different parts, namely metallic corrugated annular discs, being on one side soldered to the contact elements or supporting plates, respectively, on the other side to a partly metalized ceramic ring being the third part. The ceramic ring is the insulation between the two contact elements. A further disadvantage is the fact that the ceramic ring susceptible to shocks and that over a longer period by contact material sprayed thereon a conducting layer may be provided on the ceramic ring therby impairing the insulation values.

Similar disadvantages shows the vacuum circuit breaker switch shown in the U.S. Pat. No. 4,075,448.

To avoid the vacuum system having the mentioned disadvantages it is possible to fill the casing with an inert gas, as proposed by the German patent application P No. 28 52 471.2 of the inventor. The switch comprises as annular membrane refined steel bellows being soldered with one rim to the one contact element whereby the other rim is hermetically closed off by screws using a teflon gasket which at the same time provides the necessary insulation.

Although this switch is satisfactory for many applications, this system is still rather costly.

The main object of the invention is to provide a switch of the kind specified in the beginning of this specification being much cheaper in production as for example the switch being known from the German Offenlegungsschrift No. 27 02 103. The saving of costs should be possible without lowering the operating savety and the lifetime whereby especially the transfer resistance between the two contact elements in opened condition should not deteriorate during many operation cycles which is of special importance if the switch is to be used as a no-load switch.

This object of the invention is solved by the characterizing features of the main claim, namely,—for example in connection with a no-load switch—by providing an annular membrane consisting of—bellows made of flexible electrically insulating plastic material, the rims thereof being fastened by means of clamping band devices to the annular connection surfaces of the supporting plates surrounding the contact element.

In opposite to the known annular membrane being made from three single parts and to be soldered to the contact elements and the supporting plates, respectively, in vacuum conditions whereby in addition the ceramic ring being necessary for insulation is susceptible to shock and furthermore collects sprayed off contact material leading to deteriorating transfer resistance in case of opened contact elements this does not apply to the new switch since the bellows being made of flexible plastic material do not require complicated soldering to the contact elements or supporting plates respectively but only are to be pushed onto a corresponding seating surface whereby the clamping devices may be integrated into the plastic material so that no separate measures have to be taken to secure the annular membrane. A special advantage is the fact that the plastic material inherently is electrically insulating so that a separate insulation ring is not necessary, that the plastic material is completely unbreakable and—as experiments have shown—is able to resist to heat and material influences occurring during the lifetime of the switch and that furthermore sprayed off contact material being deposited onto the inner surface of the membrane does not stick to such surface due to the inherent movement of the membrane during the switching operation but rather falls off, thereby ensuring that the transfer resistance between the two contact elements does not deteriorate.

The sealing between the flexible membrane and the annular connection surfaces of the supporting plates is completely sufficient since no vacuum must be used. For additional security, however, an annular notch may be provided for in the annular connection surface into which fits a correspondingly formed annular bulge on the inner surface of the bellows rim. By additional clamping devices, as for example common hose clips or novel refined steel ring ties the security of the connection may be still more improved.

In order to avoid that the material of the bellows have to be made too flexible, according to a further embodiment of the invention it is of advantage if the bellows have a widening the extension thereof being adapted to the switching distance of the contact elements. If the switching distance is small, for example some millimeters only, a relatively small widening will do. If, however, the switching distance is larger, for example in those cases, when the switch is to be used as a no-load switch (in addition to a circuit breaker) for higher voltages with an opening distance of for example 16 mm bellows of larger widening are used.

The bellows must be made of plastic material securing on one hand sufficient electrical insulation and on the other hand being sufficiently resistant against environmental influences which may originate from the inside of the switch (hot gases and sprayed off contact material in case of switching operations under remaining load) as well as from the outside (acid and leach solutions and etching gases if used in electrolytic baths). So-called fluorelastomers have proved to be especially useful, for example a fluorelastomer being provided by the company 3M Deutschland GmbH under the brand name "Fluorel FC-2176" and "Fluorel FC-2177". This material is sufficiently resistant against chemicals and heat, has a high cross-linking velocity during polymerisation and high elongation under higher ambiance temperatures.

Normally the supporting plates carrying the contact elements are rigidly carried by the actuating device so that no special guidance of the two supporting plates with respect to each other inside of the switch is necessary. However, if such a switch is to be used in plants where such precise guidance of the supporting plates is not cared for, there may be—according to a further embodiment of the invention—provided in each supporting plate at least one axial hole into the corresponding contact element, especially a blind hole, whereby the holes are aligned to each other and contain an insulating guiding pin which is axially shiftable at least in one of the holes. It is advisable to provide the guiding pin with a round cross section and to hold the pin axially shiftable with small tolerance in both holes. By this assembly a sufficient guidance of the two contact elements and supporting plates, respectively, is provided in a very simple way.

The guiding pins may consist of glass fiber enforced polyamid whereby in most cases it will be sufficient if only one guiding pin is provided for in the middle relative to the contact element. In special cases, however, and with larger contact surfaces, which may be required, if very high currents are used, also several guiding pins may be provided for.

The switch according to the invention may be produced in a special cheap way if the switch—apart from the bellows—is assembled of similar elements on both contact sides. Manufacturing is also cheaper because of the fact that the enclosure needs not to be evacuated but, instead, is filled with an inert gas, for example with cheap nitrogen. This filling procedure may be effected at the final step of the production proceedings so that the preceding steps do not need any protective gas or vacuum devices. If the requirements are not too high it is even possible to do without the filling with inert gas. Some switching operations under current load lead to material burning within the housing, heating up the still present disturbing matter, especially humidity, thereby presumably binding these substances to the arising burning products, be it through absorption or adsorption or by chemical reaction, in such a way automatically providing a protection gas atmosphere.

A further reduction of the production cost is possible if—contrary to the prior art—the supporting plates being, for example, made of chromium copper, are produced in one piece by means of permanent mold casting, whereby afterwards only the supporting surfaces for the bellows and the contact elements need material treatment. Hereby the contact element may favourably comprise a metal plate being soldered into a corresponding depression in the supporting plate. Suitable material for the contact elements are for example plates made of silver nickel alloy, the silver content preferably being 90 percent.

If the supporting plate is fabricated by permanent mold casting, the blind holes at the outside of the supporting plates for fastening those supporting plates to the actuation device may be provided in a specially simple way by screw insets which are placed into the mold and then surrounded by the casting material. Instead it is, of course, possible to use threaded through holes if this is more convenient with respect to fabrication.

The new switches described before may be used as switching element in a no-load switch, which then may comprise several such no-load switching elements, especially if the current to be carried into the on-condition does exceed substancially the value of 10,000 amps., since otherwise the necessary contact surface is getting so large that the exact parallel guidance leads to mechanical difficulties.

In the same way a combination of several no-load switching elements is of advantage, if the voltage in the off-condition exceeds, for example, 1,000 to 2,000 volts, since the necessary air gap (in case of 1,000 volts alternating current or 1,200 volts direct current according to the official specifications 9 mm) and the creeping gap (for the specified voltages 16 mm) have to be increased so far that again mechanical complications will occur.

To combine several no-load switching elements to one switch the elements according to a further embodiment of the invention are placed with their supporting plates onto connection lugs which lugs are supported on one side of the switch by a fixed supporting bar and on the other side of the switch, insulated, by a supporting bar being shiftable in the direction of the switching element axis, whereby the connection lug being on the fixed bar is preferably one piece with the supporting plate while the connection lug of the movable bar preferably comprises a multitude of metal sheet strips as for example copper sheet strips in parallel to each other, thereby simplifying the construction and at the same time not impairing the movability of the shiftable bar by the rigidity of the connection lug.

Dependant whether the switch is to be connected in parallel or in series the connection lugs of switching elements being provided side by side are connected to each other in parallel or in series.

According to a further embodiment of the invention it is possible to connect two no-load switches or two no-load switching elements in such a way that a mechanical switch drive that, if turning on one switch the other switch is turned off.

If the two no-load switches or no-load switching elements are connected with two other no-load switches or no-load switching elements mechanically by a cross connection in such a way, that the switching operation opens two contacts and closes two other contacts, a double pole double throw switch is provided which, for example, may be used as a pole exchanger in the construction of switch plants, galvanic plants or electric furnaces. Especially such a double pole double throw switch may switch over from one system to another. The switch described herewith, if used as a no-load switch, has in advantage to low voltage switches of the prior art a much wider opening gap of, for example, 9 mm, thereby permitting not only the use as no-load switch for the (approximately current-free) switching on and off of current circuits, if between the opened switching elements of each pole only a relatively low voltage is present during opening of the switch, while at the same time in the off condition voltages of, for example, 1,000 volts are admissable. Furthermore, this wide opening gap also provides high operation safety.

Figure 2:
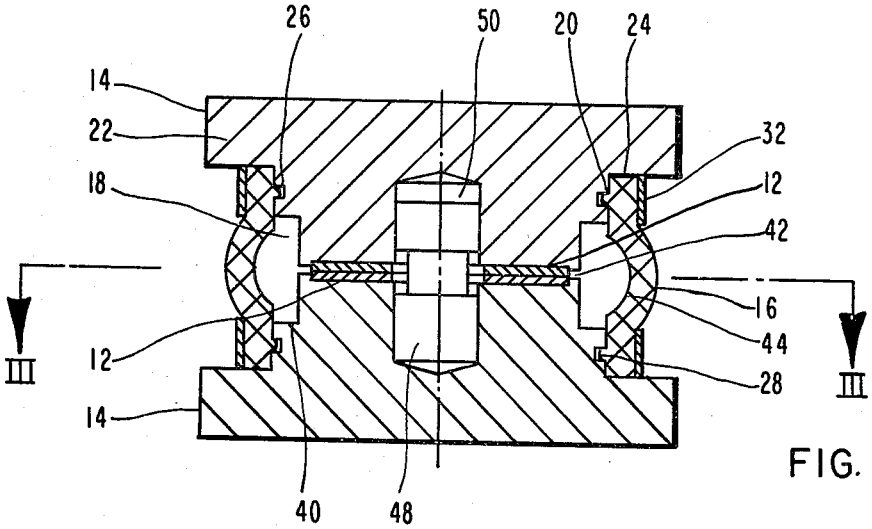
Figure 3:
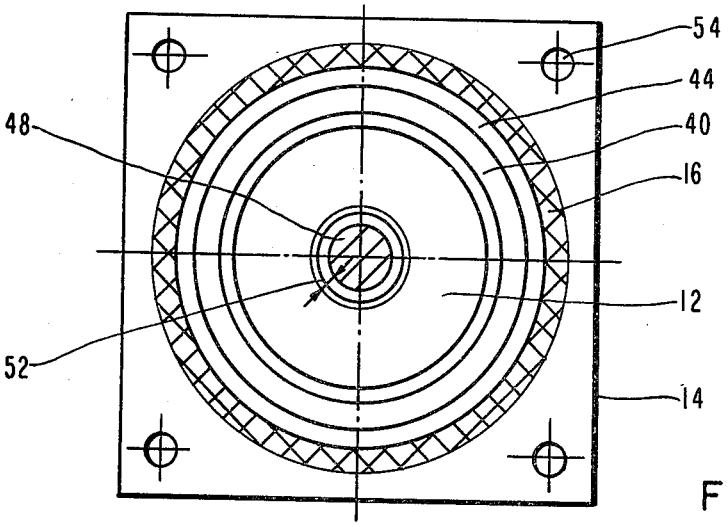
Figure 4:
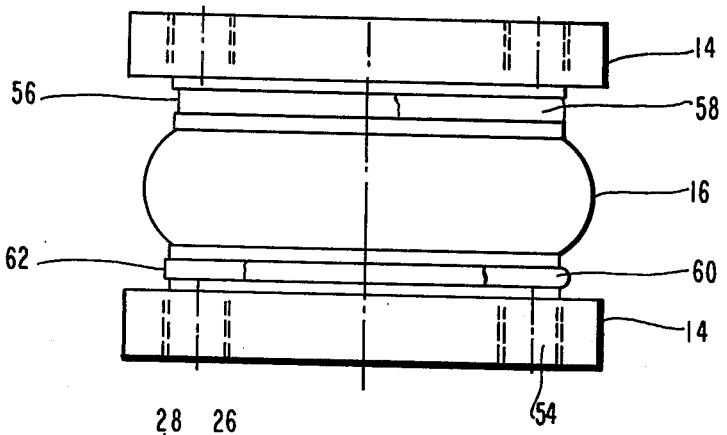
Figure 5:
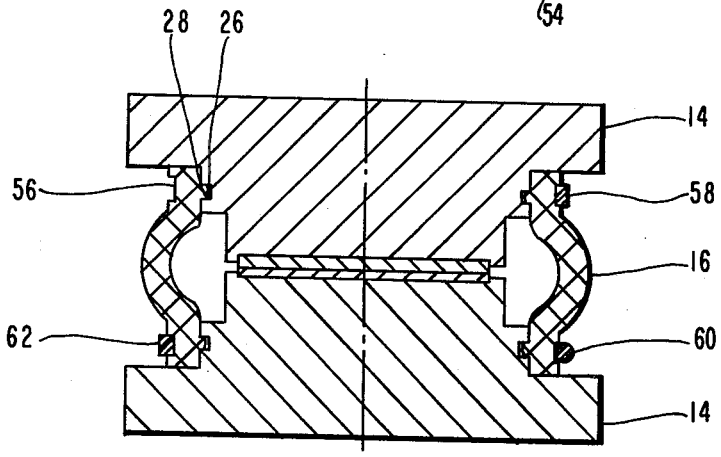
Figure 6:
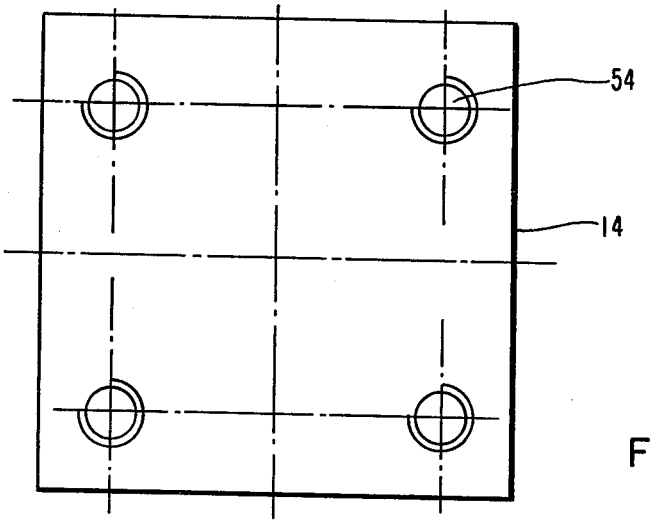
Figure 9:
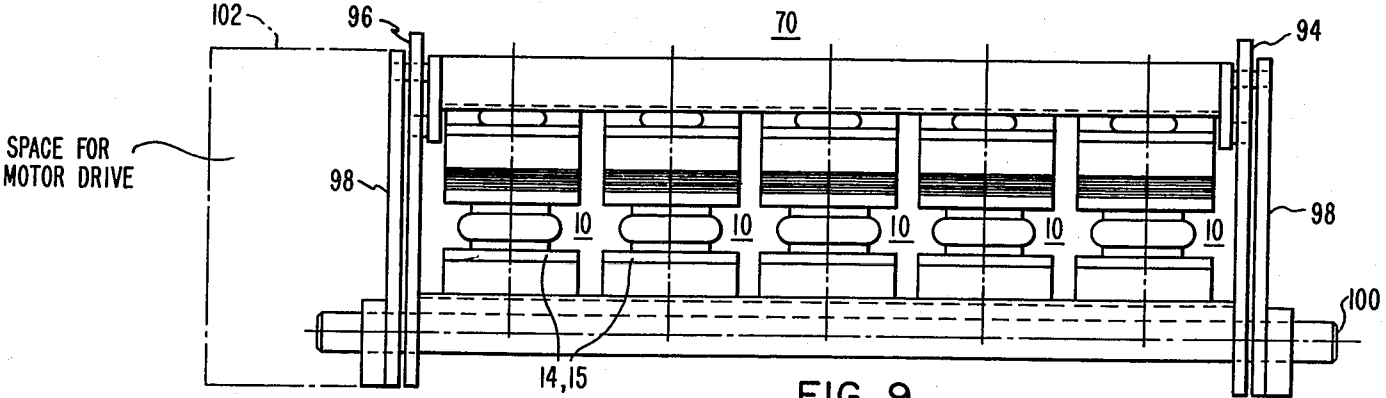
Figure 10:
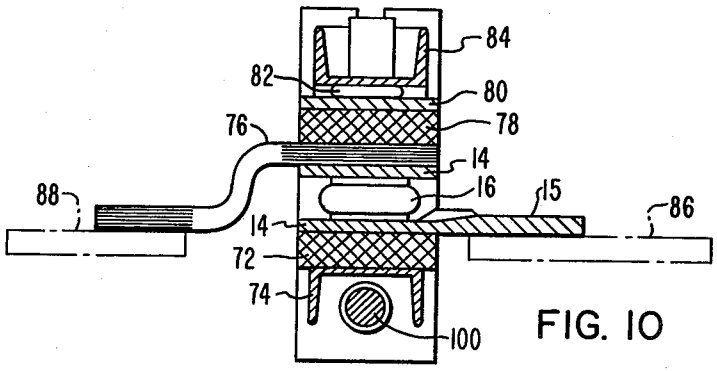
Figure 7:
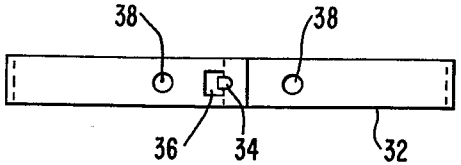
Figure 8:
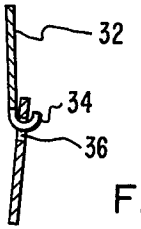

The foregoing and other features and advantages of the invention will become apparent from the following detailed description of exemplary embodiments, when read in conjunction with the accompanying drawings in which FIG. 1 is a side view of one embodiment of a no-load switch or low voltage switch, respectively, according to the invention;

FIG. 2 an axial section through the switch shown in FIG. 1, having according to the shown embodiment a guiding pin;

FIG. 3 a cross-section through the switch of FIG. 2 along the lines III—III;

FIG. 4 a side view of another embodiment of the switch according to the invention;

FIG. 5 an axial section through the embodiment shown in FIG. 4;

FIG. 6 a top view onto the switch shown in FIG. 4;

FIG. 7 a perspective view of a new hose clamp being specially useful as a clamping device;

FIG. 8 a detailed view of a closure of this hose clamp shown in FIG. 7;

FIG. 9 a side view of a switch comprising five switching elements;

FIG. 10 a section through one of the switching elements of FIG. 9; and

Figure 11:
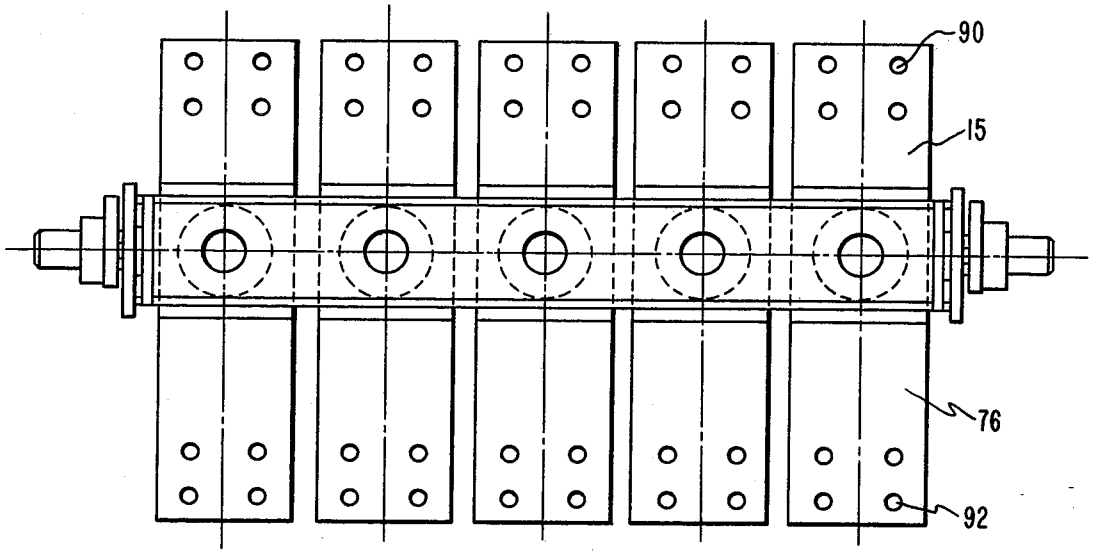

FIG. 11 a top view onto the switch shown in FIG. 9.

FIG. 1 shows in a side view a switch 10 according to one embodiment of the invention, which switch is shown in FIG. 2 in a longitudinal section and in FIG. 3 in a cross section in more detail. The switch comprises two contact elements being opposite to each other and consisting of two circle shaped contact plates 12, each carried by a supporting plate 14. Preferably the contact disc 12, which may, for example be made of silver alloy with a silver content of approx. 90 percent is placed into a depression in the front surface of the supporting plate 14 and soldered thereto with the whole surface. This depression provides a special protection of the rim of disc 12 against detachment in case of strong thermic load.

To avoid soiling of the contact surface and to avoid—especially if used with electrolytic baths—the introduction of harmful gases the contact elements 12 are surrounded gastight by a ring-shaped membrane 16 connecting the two supporting plates 14 gastight with each other. This way the two supporting plates 14 together with the ring-shaped membrane 16 form a closed chamber 18 wherein the contact plates 12 are movable in protective way in axial direction to each other. The two supporting plates 14 may be moved to each other by means not shown in detail until the two contact discs 12 are abutting each other with their complete surface forming a current bridge with a transfer capacity of several thousand amperes with very low voltage drop. If, however, the two supporting plates 14 and thereby the contact discs 12 are separated from each other by the actuation device, for example, to a distance of 16 to 20 mm, the current circuit is interrupted.

To keep the pulling stress and pressure stress of the material of membrane 16 as low as possible, this membrane 16, according to FIG. 2 is provided with a bulge protruding to the outside so that the ring-shaped membrane constitutes a kind of bellows The bellows being made of flexible, electrically insulating plastic material are supported with their interiour rims by ring-shaped supporting surfaces 20 surrounding the contact element 12, which surfaces 20 are provided by the supporting plates 14. Preferably this ring-shaped surface 20 is depressed so far with respect to the basis member 22 of the supporting plate 14, which by itself needs not be circular but also be square as shown in FIG. 3, in such a way that on the whole circumference a supporting surface 24 is provided for the annular membrane 16.

The secure fitting and the gasimperviousness of the connection between membrane 16 and supporting plate 14 may be improved and enhenced by milling a notch 26 in the ring-shaped fastening surface 20 into which a correspondingly formed ring-shaped prominence or bulge 28 of the inner surface of the rim of bellows 16 may be provided for. As a further means an additional clamping device 30 is cared for in the embodiment as shown, comprising either a common hose clip 30 or a special clamping device in the shape of a hose strip fastener shown in FIG. 7 in perspective view which is easier to mount and provides a more even pressure.

The clamping device of FIG. 7 comprises a refined steel bond 32, ending on one side in a hook 34 extending to the outside, see the partly cut view of FIG. 8, whereby the hook 34 has a width which is smaller than the width of the strap 32. The other end of the bond 32 ends in a window-like opening 36 which for clamping the membrane 16 with the strap 32 is positioned over the hook 34. Contrary to hose clips of the prior art this strap does not lead to bulging of the clamped material in the area of the strap ends during the fastening operation, in addition thereto this bond is musch faster to be mounted.

In order to facilitate gripping and streching of the steel bond 32, two additional round openings 38 are provided near to the bond ends into which corresponding gripper tools may be placed for drawing together the two ends of the steel bond 32, thereby passing the window 36 over the hook 34 and thus locking the steel bond 32 around the membrane 16.

Behind the annular fastening surface or shoulder 20 the supporting plate 14 is again recessed, thereby providing a further step 40 from which the proper support for the contact plate 12 extends cylindrically. This way all the surface areas of membrane 16 lining the interior of the switch housing have approximately the same distance from the contact plate aperture 42 so that material being ejected out of the gap is distributed evenly onto this surface 44, providing an even higher lifetime for the membrane material.

Membrane 16 is preferably made from a fluorelastomer which is sufficiently resistent against chemical attack from the outside, which may occur if the switch is used in electrolytic baths as well as against chemical and thermic attacks from inside. This material is of advantage because of the fact that the raw elastomer may be handled by means of very simple injection molds, thereby allowing without heavy costs for molding tools to produce a series of switches with stepwise different nominal current values so that an exact adaptation of the switch to the respective necessary current load and thereby most effective use of space is possible. For example, one series of moduls may be provided, extending from a nominal current of 1000 amps. in steps of 1000 to 10,000 amps. The tool cost for each nominal current value i.e. the costs for the injection molds for manufacturing supporting-plate 15, for example, by means of permanent mold casting, remains limited. In addition both supporting plates 14 are completely identical, as is shown in FIG. 2, so that both supporting plates 14 may inexpensively be manufactured with a single mold only.

A further advantage of the manufacturing by means of permanent mold casting is the fact that in a very simple manner threaded blind holes may be provided in the basis member 22 of supporting plate 14 (the hole is not shown) by using corresponding insets during the permanent mold casting being surrounded by casting material after the casting process. Alternatively such blind holes 54 may also be provided later (FIG. 4) or through holes 44 may, for example, be placed in the four corners of the rectangular supporting plate 14, as shown in FIG. 3.

If the actuation device for the two supporting plates 14 of switch 10 has no or no sufficient axial guidance such an axial guidance may be provided within the switch as shown in FIG. 2. Here the axial guidance simply comprises a guiding pin 48 which, with a certain tolerance 52, is guided in a blind hole 50 arranged in each supporting plate 14. This guiding pin 48 may, for example, be made of glass fiber enforced polyamid.

The guiding pin 48 is not always necessary, so the FIGS. 4 to 6 show an embodiment of the switch according to the invention having no such additional guidance. Besides, the shown embodiment is quite similar to the embodiment shown in FIGS. 1 to 3, whereby however, instead of through holes 44 blind holes 54 are provided to fasten the supporting plates at the switch actuation devices (not shown).

As shown in FIG. 5, membrane 16 may at its exterior rims be provided with a depression 56 which is positioned above a bulge 28 which is also provided in this case (and which engages into a notch 26 in the ring-shaped fastening surface 20), into which depression for example a fastening spiral 58, a fastening ring 60 or a tie 62 may be positioned.

The somewhat more complicated provision of blind holes in place of through holes has the advantage that for exchanging older switches by the new switches the whole exterior surface of the supporting plate is available so that bore hole distribution of any kind may be realized.

The several embodiments of switches, especially no-load switches are, as already mentioned, applyable for switching currents in the range of 1,000 to, for example, 12,000 amps., depending on the surface of the contact plate, whereby such no-load switch may be used as a switching element for constructing a no-load switch comprising several switching elements of the described kind.

FIG. 9, for example, shows a switch 70 being mounted of five switching elements 10, whereby FIG. 10 is a cross section through one of the switching elements 10. As may be ascertained from the figures the lower supporting plate 14 comprising as one piece a connection lug 15 extending to the outside is carried by an insulating member 72 which by itself is fixed to a mounting bar 74 with U-shaped cross-section.

The upper supporting plate 14 clamps with a further supporting plate 80 a connection lug 76 comprising several single copper sheet strips sandwich like between two further insulating members 78. This member comprising the parts 14, 76, 78 and 80 is connected by a pad like connection member 82 with an—also U-shaped—upper mounting bar 84 being shiftable in the direction of the axis of switch 10.

The lower connection lug 15 and the upper connection lug 76 are each connected to connection contact strips 86 and 88 respectively, in FIG. 10 only shown by broken lines, whereby the connection is effected for example by way of four screws being lead through four corresponding bores 90 and 92 in the lower and the upper connection lug 15 or 76, respectively, see FIG. 11.

The mounting bars 74 and 84 are carried by a frame construction of appropriate design, which frame may be carried, for example, by side plates 94, 96, whereby the upper mounting bar is connected at both ends to an eccentric drive thus movable up and down, whereby the drive may be effected by means of crank rods 98 arranged on both sides, which crank rods being in connection with a driving shaft 100. This driving shaft 100 may either be actuated by manual drive as for instance by a lateral lever or by a rotational front drive or alternatively by motor drive, for which motor, for example, in FIG. 9 a corresponding space 102 is provided on the left side.

The distance between the individual connection lugs 76 and 15, respectively, as well as the distances between the contact elements within the separate switching elements 10 depend on the voltage to be applied to the switch in off-condition. If the separate connection lugs 76 and 15, respectively, are parallel to each other, to get higher nominal current load, the distances are of no importance with regard to voltage load. However, for getting higher nominal voltage resistance, the connection lug 15 of one switching element 10 is connected to the connection lug 76 of the next following switching element 10 by a bridge connection, whereby the connection lug 15 of such further switching element is again connected to the connection lug 76 of the next following switching element, and so on.

In most cases it will be more advantageous to provide correspondingly wider gaps between the contact elements for higher voltages and to use the combination of several no-load switching elements only for the purpose of getting higher nominal current load.

Since the switching operations are effected at nearly no-load conditions so that during switching off no excessive high current is passing through the switch and likewise only a small voltage lies across the contact elements no arcs or at least no heavy arcs occur between them. The no-load switch according to the invention, therefore, is suited for higher nominal power rates as well as for higher switching frequencies than a switch being used for full load conditions.

With respect to no-load switches of the prior art comprising knife contact constructions without special enclosures, the switch according to the present invention, especially, if used as no-load switch provides much higher operation safety as well as lower production costs if the same nominal current is applied. A further advantage is the compact construction as well as lower susceptibility to environmental influences.

Switches of the kind shown in FIG. 9 as well as switches comprising one element only may also be combined in such a way that there is a possibility to switch over. For this purpose—for one pole operation—two switching elements or switches are combined mechanically with each other in such a way that, while closing one switch or switching element, the other switch or switching element is opened.

If more switches or switching elements are combined by a cross-connection a two-pole two throw switching operation is provided.

The switch may be used not only as a no-load switch, but also as a low-voltage breaker switch or cross over switch, whereby very high currents are switchable. By using the guiding pin a guiding is provided which is strong enough for handling even those forces which occur during switching very high currents (for instance some 1000 amps.), which forces originate in the magnetic force of those currents.

For switching operations under current load, especially in case of breaking a circuit carrying a very high current, the two supporting plates 14 and thereby the contact plates 12 are separated by the actuation device, for example by separating same to a distance of 3 to 4 mm, whereby the current is interrupted, during which opening operation for a short period of time an arc is produced which arc, however, regularly extinguishes very soon in view of the very low voltage applied. However, by the effect of the arc a small part of the contact material is liquefied and evaporated and radially ejaculated outwards through the gaps between the contact discs 12 against membrane 16. But, since the membrane is flexed and deflected during axial movement of the two supporting plates 14 the sprayed off contact plate materials cannot stick to the inner wall of membrane 16 but rather fall off and, in the course of time, collect at the lower end of the housing space 18, where they will do no harm. The inherent flexibility of the annular membrane 16, therefore, effectively avoids a decrease of the creeping resistance between the two contact elements 12 in the opened position of switch 10.

What we claim is:

1. Switch comprising contact elements being carried opposite to each other by supporting plates which are actuatable by axially effective forces, a casing hermetically enclosing the contact elements, said casing being formed by the supporting plates and an annular membrane, the membrane being hermetically connected to the two supporting plates, characterized in that the annular membrane (16) is formed by bellows of flexible, electrically insulating, plastic material, the rims of the bellows being connected by means of clamping devices (30) to annular connection surfaces (20) of the supporting plate (14) surrounding the contact element (12), said annular connection comprising an annular notch into which fits a correspondingly formed annular bulge on the inner surface of the bellow rim, and said clamping device comprising a fine steel bond formed into a ring.

2. Switch according to claim 1, characterized in that the bond ending at one end in a hook (34) extending outwards and having a width being smaller than the width of the bond (32), while the other end of the bond (32) comprises a window like opening (36) to receive the hook (34).

3. Switch according to claim 2, characterized in that near each end of the steel bond (32) there is provided an opening (38) to receive the tips of tongs.

4. Switch according to claim 1, characterized in that the bellows (16) comprise a widening the extension thereof being adapted to the switching extension of the contact elements (12).

5. Switch according to claim 1, characterized in that the bellows (16) are made of insulating elastic plastic material.

6. Switch according to claim 5, characterized in that the plastic material is a fluorelastomer.

7. Switch according to claim 1, characterized in that the supporting plates (14) each comprise at least one hole (50) axially extending into the corresponding contact element (12), the hole being especially a blind hole, the holes being aligned to each other and containing an insulating guiding pin (48) being axially movable at least in one of the holes (50).

8. Switch according to claim 7, characterized in that the guiding pin (48) has a round cross section and is axially displaceable with small tolerance (52) in both holes (50).

9. Switch according to claim 7, characterized in that a guiding pin (48) made from glass fiber enforced polyamid is provided in the middle with respect to the contact element (12).

10. Switch according to claim 1, characterized in that the switch (10) comprises similar elements for both contact sides, with the exception of the bellows (16).

11. Switch according to claim 1, characterized in that the casing is filled with an inert gas, especially nitrogen.

12. Switch according to claim 1, characterized in that the casing during assembly is filled with air and that the humidity is removed after closing the casing by frequent actuation of the switch (10) through the effect of the arc and the material burning by the electric current.

13. Switch according to claim 12, characterized in that the casing is filled with dried air during assembly.

14. Switch according to claim 1, characterized in that the contact element comprises a supporting plate (14) from a hard copper alloy, especially chromium copper, the carrying plate having a depression into which a round plate (12) from silver or a silver alloy is soldered.

15. Switch according to claim 1, characterized in that the supporting plate (14) is provided with screw blind holes (54) extending to the outside of the switch.

16. Switch according to claim 15, characterized in that the supporting plate (14) is manufactured by permanent mold casting and that the screw blind holes (54) are provided by screw sockets being surrounded by cast material.

17. Switch according to claim 1, characterized in that several switching elements (10) are carried with their supporting plates (14) on connection lugs (15, 76) which again are supported on one side of the switch (10) by a fixed supporting bar (74) and on the other side of the switch insulated (insulating member 72, 78, respectively) by a supporting bar being movable in the direction of the switch element axis.

18. Switch according to claim 17, characterized in that the connection lug (15) on the fixed bar (74) is one piece with the corresponding supporting plate (14).

19. Switch according to claim 17 or 18, characterized in that the connection lug (76) on the movable bar (84) comprises several metal sheet strips as for example copper sheet strips the strips being parallel to each other.

20. Switch according to claim 17, characterized in that the connection lugs (15) of the one bar (74) and the connection lugs (76) of the other bar (84) are each connected to each other (for example by means of connection bars 86, 88).

21. Switch according to claim 1, characterized in that two respective switches (70) or switching elements (10) are connected with a mechanical switching drive in such a way that during switching on the one switch the other switch is switched off.

22. Switch according to claim 21, characterized in that respectively two switches or switching elements (10) are combined with two other switches (70) or switching elements (10) by means of a cross connection in such a way that a double-pole double throw switch (pole exchanger) is provided.

23. Switch according to claim 17, characterized in that the bars (74, 84) are supported by a driver casing (94, 96) and that the movable bar (84) is shiftable in the direction of the axis of the switching elements (10) by means of a shank drive (98) and a driving shaft (100).

24. Switch according to claim 23, characterized in that the driving shaft (100) is connected with a manual drive like a lateral level, a front rotational drive or a motor drive (102).

25. Switch according to claim 1, characterized by the application as no-load switch.

26. Switch according to claim 1, characterized by the use as a low voltage circuit breaker switch or low voltage throw over switch.

* * * * *